US005733445A

United States Patent [19]

Fanelli

[11] Patent Number: 5,733,445

[45] Date of Patent: Mar. 31, 1998

[54] STORM SEWER CATCH BASIN FILTER

[76] Inventor: Anthony T. Fanelli, 50466 Heatherwood La., Utica, Mich. 48317

[21] Appl. No.: 690,206

[22] Filed: Jul. 25, 1996

[51] Int. Cl.[6] ..... E03F 1/00

[52] U.S. Cl. ..... 210/164; 210/232; 210/237; 210/484; 210/489; 210/492; 404/4

[58] Field of Search ..... 210/163, 164, 210/165, 166, 232, 237, 483, 484, 485, 489, 492; 404/2, 3, 4, 5

[56] References Cited

U.S. PATENT DOCUMENTS

| | | | |
|---|---|---|---|
| 414,240 | 11/1889 | Norton . | |
| 2,117,887 | 5/1938 | Holland . | |
| 3,089,396 | 5/1963 | Rowland . | |
| 3,252,580 | 5/1966 | Getzin | 210/485 |
| 3,724,671 | 4/1973 | Tate | 210/484 |
| 3,815,748 | 6/1974 | Johannessen . | |
| 3,815,749 | 6/1974 | Thompson . | |
| 4,367,142 | 1/1983 | Blecher . | |
| 4,419,232 | 12/1983 | Arntyr et al. | 210/164 |
| 4,682,907 | 7/1987 | Gaudin . | |
| 4,732,675 | 3/1988 | Badolato et al. | 210/484 |
| 4,776,722 | 10/1988 | Gaudin . | |
| 4,935,132 | 6/1990 | Schaier . | |
| 4,988,235 | 1/1991 | Hurley | 210/164 |
| 5,032,264 | 7/1991 | Geiger . | |
| 5,037,541 | 8/1991 | Ruey-Jang et al. | 210/165 |
| 5,056,276 | 10/1991 | Nielsen et al. | 210/474 |
| 5,062,735 | 11/1991 | Gaudin . | |
| 5,069,781 | 12/1991 | Wilkes . | |
| 5,096,582 | 3/1992 | Lombardi et al. | 210/483 |
| 5,133,619 | 7/1992 | Murfae et al. | 404/5 |
| 5,171,437 | 12/1992 | Fletcher, Sr. | 210/484 |
| 5,222,154 | 6/1993 | MacPherson, Jr. et al. . | |
| 5,232,587 | 8/1993 | Hegemier et al. . | |
| 5,284,580 | 2/1994 | Shyh . | |
| 5,345,741 | 9/1994 | Slater et al. . | |
| 5,372,714 | 12/1994 | Logue, Jr. . | |
| 5,375,940 | 12/1994 | Kobayashi | 404/3 |
| 5,391,295 | 2/1995 | Wilcox et al. . | |
| 5,403,474 | 4/1995 | Emery . | |
| 5,405,539 | 4/1995 | Schneider . | |
| 5,480,254 | 1/1996 | Autry et al. . | |
| 5,486,287 | 1/1996 | Murphy et al. . | |

*Primary Examiner*—Neil McCarthy
*Assistant Examiner*—Theodore M. Green
*Attorney, Agent, or Firm*—Vanophem Meehan & Vanophem, P.C.

[57] ABSTRACT

A removable filter assembly includes a relatively thin support grate positioned on top of an inlet grate, a filter fabricated from a geotextile material is positioned on the support grate and has an appropriate filter size for removing suspended particulate materials from ground water before the ground water passes into the catch basin, and a covering grate positioned above the filter for protecting the filter from contact damage caused by passing vehicular traffic. The cover includes depending sides for positioning the covering grate and blocking flow. In one embodiment, the support grate has a plurality of spaced apart pads around the exterior thereof, and the filter is placed on the support grate and over the pads. The pads extend into holes in the covering grate to trap the filter therebetween. The covering grate also has a depending peripheral flange that depends downwardly to circumscribe the support grate and an upper portion of the inlet grate. The covering grate is also provided with removable or permanent handles for removing the covering grate and changing filters.

16 Claims, 3 Drawing Sheets

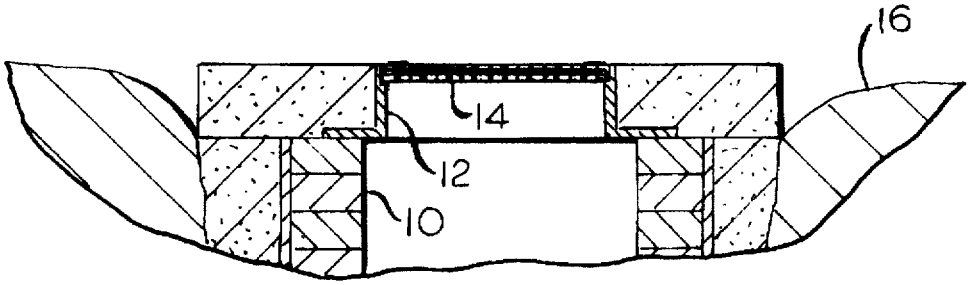
FIG. 1
FIG. 2
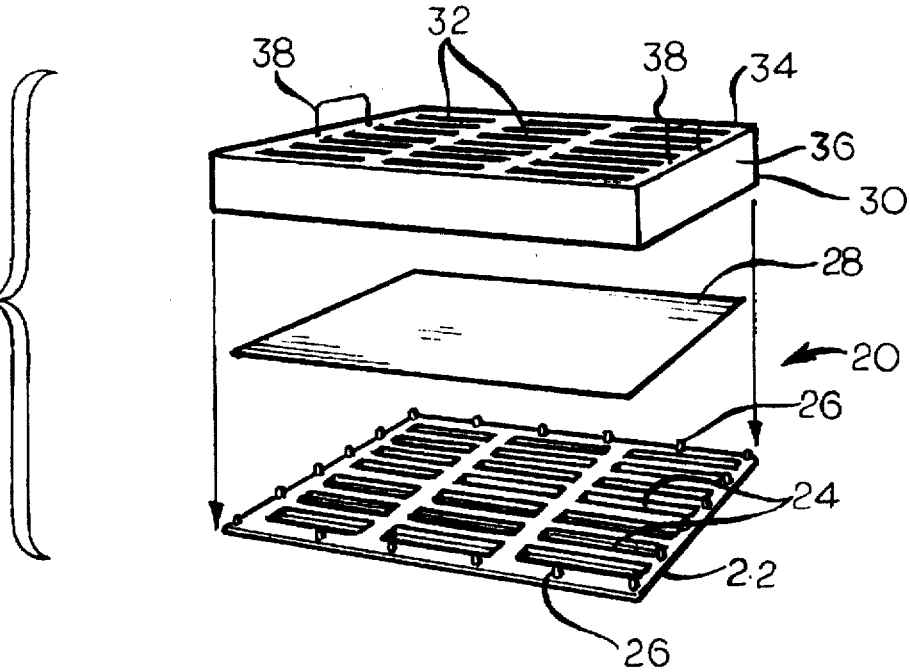

STORM SEWER CATCH BASIN FILTER

BACKGROUND OF THE INVENTION

1. Field of the Invention

This application relates to a filter for filtering silt and other particulate materials from ground water before the water enters a storm sewer catch basin. More particularly, this invention relates to a filter that can readily be removed by hand from an inlet to a storm sewer catch basin. The filter can be easily replaced without lifting of the heavy catch basin inlet cover.

2. Description of the Prior Art

U.S. Pat. No. 5,372,714 (Logue, Jr.) describes a removable filter for the inlet to a storm sewer catch basin for removal of silt and other finely divided particulate material from ground water before the ground water enters the sewer line. The problem of silt runoff is especially serious during new construction in a real estate development, because much if not all, of the land in the development has not been landscaped, and silt runoff is much more of a problem from land that has not been landscaped than it is from land that has been fully landscaped. In fact, for environmental reasons, many governmental bodies have issued regulations requiring filtration of catch basin inlets during construction because the problem of silt runoff during heavy rains or during periods of rapid melting of snow or ice is especially acute at these times. This is also done to prevent build-up of silt in the sewer system resulting in the blockage of drains.

The aforesaid U.S. Pat. No. 5,372,714 teaches filtering solids from ground water by providing a filter bag formed from a plastic material with small openings therein, often called a geotextile material, within the catch basin at an elevation below that of the grate that normally closes the opening into the catch basin. Unfortunately, the filter bag of the aforesaid U.S. Pat. No. 5,372,714 is only designed to hold a very large quantity of filtered solids, and cannot readily be removed by hand because of the weight of such a quantity of material. Furthermore, to retrofit such a device to a catch basin requires many custom charges and has significant drawbacks, such as heavy lifting and expensive, custom inlet covers.

U.S. Pat. No. 5,403,474 (Emery) also deals with the problem of filtration of sediment in ground water before the ground water enters a storm sewer catch basin, and it teaches the use of a filter frame positioned on the roadway in alignment with a curbside gutter. Unfortunately, the filter frame of this reference has a substantial vertical extent, and extends for a substantial distance above the elevation of adjacent portions of the roadway. The filter frame of this reference, thus, is an impediment to vehicular traffic passing along the roadway, and contact of the filter frame by a passing vehicle can cause an unsafe situation for the passing vehicle or it can dislodge the filter frame from its desired position, with a resulting loss of its filtration effectiveness.

SUMMARY OF THE INVENTION

The aforesaid and other problems associated with the filtration of particulate materials from ground water flowing into a catch basin are resolved by a filter according to the present invention. A filter according to the present invention is in the form of a relatively thin, generally horizontally extending assembly that is adapted to be placed above the catch basin inlet grate. The filter includes a relatively thin metallic support grate that removably rests on the catch basin inlet grate, a filter in the form of a thin, generally planar layer of a suitable filter material that rests on and is supported by the support grate and a covering grate that rests on the support grate and protects the filter from damages as a result of contact by passing vehicular traffic, or otherwise. The covering grate is of a relatively thin metallic material with a depending peripheral flange that depends into the catch basin opening to circumscribe the support grate and filtration material and at least an upper portion of the catch basin inlet grate, to thereby accurately position all elements of the filter with respect to one another and with respect to the inlet grate.

The covering grate of the filter of the present invention is provided with either removable or permanent handles. The permanent handles preferably fold out of the way when not in use, to permit the covering grate to be removed when it is time to inspect or replace the filter. The removable handle is carried by a worker and used as necessary. Once the covering grate is removed, the support grate and the filtration material can be manually removed, in unison or separately, for replacement of the filter, if necessary. In that regard, the weight of the support grate and the filter, even if the filter has a relatively large volume of accumulated particulate material supported thereon, is such that it can be handled by only one worker without mechanical lift equipment and without any silt or particulate matter by-passing the filter.

Accordingly, it is an object of the present invention to provide an improved filter assembly for filtering silt and other particulate material from ground water flowing into a storm sewer catch basin. It is a further object of the present invention to provide a filter assembly of the foregoing character that can be handled manually when it is time to inspect or replace a filter element of the filter assembly.

It is also an object of the present invention to provide a filter assembly of the foregoing character that is relatively thin in its vertical extent, to thereby avoid posing an obstacle to the passage of vehicular traffic on a roadway having a storm sewer catch basin that is protected by such a filter assembly.

For a further understanding of the present invention and the objects thereof, attention is directed to the drawings to the following brief description of the drawings, to the detailed description of the preferred embodiment, and to the appended claims.

BRIEF DESCRIPTION OF THE DRAWINGS

FIG. 1 is a fragmentary sectional view of a storm sewer catch basin having an inlet grate that is protected by a filter assembly according to the preferred embodiment of the present invention;

FIG. 2 is an exploded perspective view of the filter assembly of FIG. 1;

DETAILED DESCRIPTION OF THE PREFERRED EMBODIMENT

Figure 3:
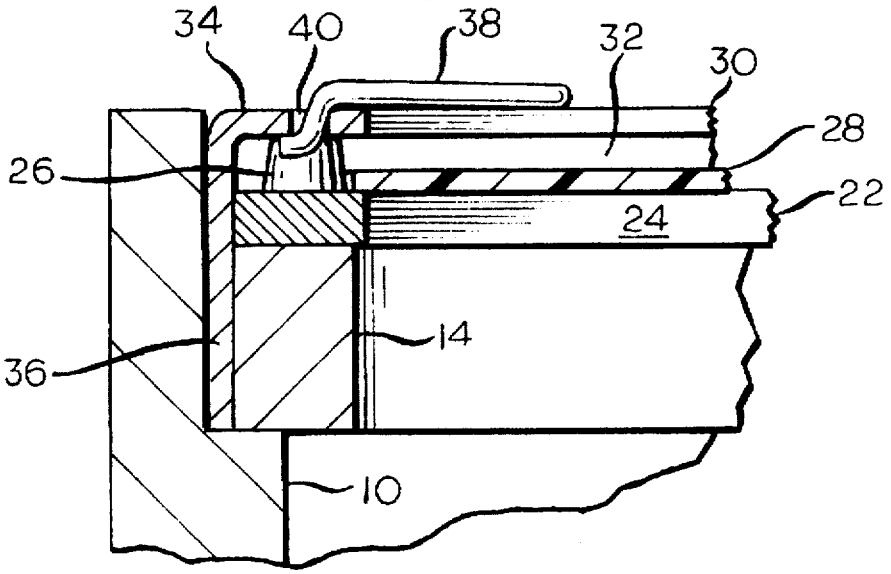
FIG. 3 is a fragmentary sectional view, at an enlarged scale, showing the filter assembly of FIG. 2 in place over a storm sewer catch basin.

Referring generally to FIGS. 1 through 4 and in particular to FIG. 1, there is shown a storm sewer catch basin identified by reference numeral 10 which is normally covered by an inlet fixture 12 having a generally horizontally extending inlet grate 14. As is known in the art, the inlet grate 14 has a plurality of openings having a patterned configuration therein to permit ground water to flow into the catch basin 10, such openings being too large, however, to prevent silt or other finely divided particulate materials from passing into the catch basin 10 with the ground water in which such particles are suspended. The inlet grate 14 may have any configuration for its plurality of openings.

The upper surface of the inlet grate 14 is preferably positioned at an elevation that is about the same as, or slightly lower, than the elevation of a roadway 16 in which the catch basin 10 and the inlet fixture 12 are installed, for proper flow of ground water by gravity into the catch basin 10 without posing an obstruction to vehicular traffic travelling on the roadway 16.

To prevent silt or other finely divided particulate materials suspended in ground water (as well as larger foreign material such as glass or leaves) from entering the catch basin 10 which would normally pass through the inlet grate 14, a filter assembly, generally indicated by reference numeral 20, is placed over the inlet grate 14. The use of a filter such as the filter assembly 20 which retrofit to the known inlet grate 14 is especially important for environmental reasons during periods of heavy construction activity in areas proximate to the catch basin 10, as silt runoff during heavy rainstorms is especially troublesome during such periods because many, if not all, of the proximate areas have not been landscaped.

The filter assembly 20 includes a support grate 22, which is preferably fabricated from a thin, metallic material, such as galvanized steel, for example, by stamping, and which is adapted to rest on the upper surface of the inlet grate 14. The support grate 22, like the inlet grate 14, has a plurality of openings therein to permit ground water to flow therethrough, such openings being identified by reference numeral 24. The openings 24 are preferably designed to match the pattern of the inlet grate 14 and therefore are too large to prevent silt and other particulate materials suspended in the ground water reaching the filter assembly 20 from flowing into the catch basin 10. In the preferred embodiment, the openings 24 of the support grate 22 directly match and correspond to the openings of the inlet grate 14. However, it is possible to vary the openings 24 from the openings of the inlet grate 14 to achieve a change in flow or other effect.

The support grate 22 is also provided with a spaced-apart plurality of upstanding pads 26, which are arranged in an endless array around the support grate 22 preferably at a location external to the openings 24 and near an outer edge of the support grate 22. The pads 26 preferably have a low profile and will function to hold a filter element in place as described below.

A preferably thin, planar filter element 28 is placed on the support grate 22 to cover all of the openings 24 in the support grate 22. Thus, all ground water entering the catch basin 10 through the support grate 22 and then through the inlet grate 14 must first pass through the filter element 28.

By a suitable selection of the material from which the filter element 28 is fabricated, the passage of silt or other particles suspended in the ground water entering the catch basin 10 may be reduced to an acceptable level or eliminated. The particles removed from the ground water remain on the upper surface and trapped in the filter element 28 until the filter element 28 is removed for replacement or cleaning, as hereinafter described. In that regard, it has been found that a suitable degree of filtration of silt from ground water may be obtained by fabricating the filter element 28 from a nonwoven, needlepunched geotextile material, such as that marketed by Linq Industrial Fabrics, Inc. However, any type of suitable filter material may be used as appropriate.

The filter element 28 is protected from contact damage caused by vehicular traffic passing along the roadway 16 by protecting it with a covering grate 30, which is supported on the pads 26 of the support grate 22 so the bottom side of the covering grate 30 rests on or slightly above the upper level of the filter element 28. The covering grate 30 has a plurality of openings 32 therein to permit ground water to flow therethrough, the openings 32 being too large to prevent silt and other particulate materials suspended in the ground water from reaching the filter element 28. The openings 32 preferably have a pattern directly corresponding to the pattern on the inlet grate 14 and support grate 22.

The covering grate 30 is also preferably fabricated from a thin, metallic material, such as galvanized steel, and has a horizontal member 34, which rests on the pads 26 on the support grate 22 and in which the openings 32 are located, and a depending peripheral member 36.

The peripheral member 36 of the covering grate 30 depends preferably 90° downward to circumscribe the filter element 28, the support grate 22 and at least an upper portion of the inlet grate 14 of the inlet fixture 12 to accurately position the support grate 22 and the covering grate 30 with respect to one another and with respect to the inlet grate 14. The filter element 28 is preferably accurately positioned with respect to the support grate 22 by the pads 26 inserted in the holes 27 of the filter element 28. The pads 26 also provide sufficient vertical clearance between the covering grate 30 and the filter element 28 to allow for a reasonable build-up of silt on the filter element 28.

Figure 4:
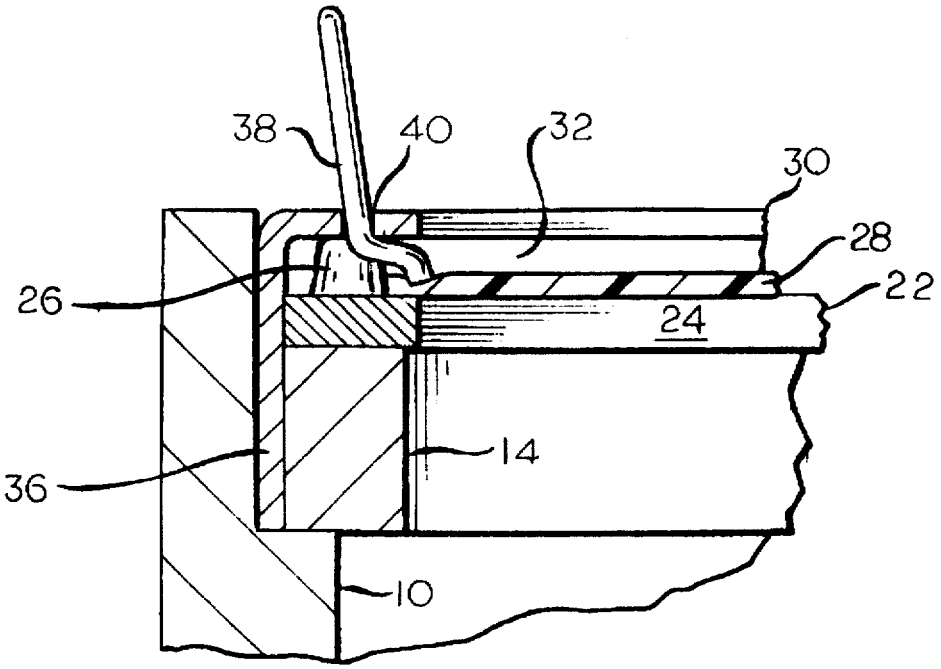
FIG. 4 is a view similar to FIG. 3 showing the filter assembly of FIG. 2 at a time when it is ready to be removed.

The covering grate 30 of the embodiment shown in FIGS. 3 and 4 is provided with an opposed pair of generally U-shaped handles 38, the free ends of which extend downwardly through apertures 40 in the horizontal member 34 of the covering grate 30. Each of the handles 38 is rotatable through an arc of approximately 90° from a substantially horizontal, rest position, as illustrated in FIG. 3 to a generally vertical, upright position, as illustrated in FIG. 4. In the FIG. 3 rest position of handle 38, the handle 38 does not pose an obstruction to passing vehicular traffic, and in the upright position of the handle 38, as illustrated in FIG. 4, the covering grate 30 can be easily lifted and removed. Thereafter, the support grate 22 and the filter element 28 can be removed by hand, in unison, if the filter element 28 is fully loaded or nearly fully loaded, or separately, for replacement of the filter element 28, or for the cleaning thereof, depending on the type of material used in the fabrication of the filter element 28 or the wishes of the developer or other individual concerned with the accumulation of excessive debris on the filter element 28.

Figure 5:
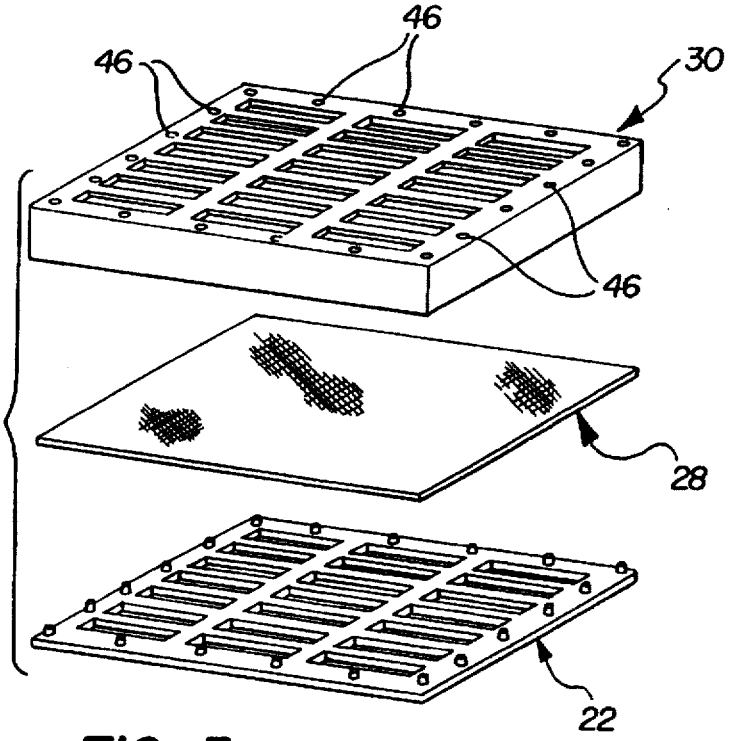
FIG. 5 is an exploded perspective view of an alternative embodiment of the present invention.
Figure 6:
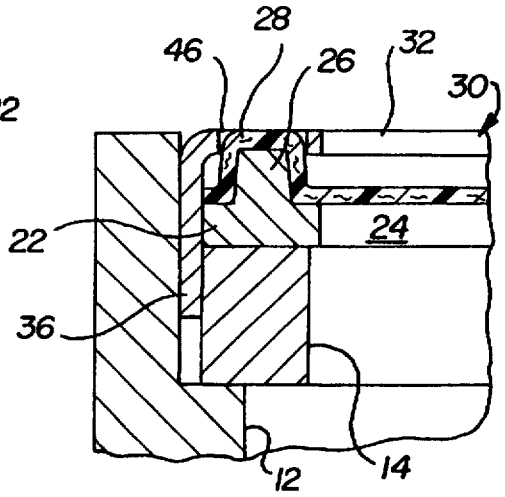
FIG. 6 is a fragmentary sectional view showing the filter assembly of FIG. 5 in place over a storm sewer catch basin.

In an alternative embodiment shown in FIGS. 5 and 6, the covering grate 30 is provided with a second plurality of holes 46 arranged about the periphery of the covering grate 30. The holes 46 are positioned to match the posts 26 of the support grate 22. When the covering grate 30 is positioned on the support grate 22 and inlet grate 14, the posts 26 extend into a respective hole 46.

In the present embodiment, the filter element 28 is sized to extend over all of the posts 26 of the support grate 22 so the filter element 28 is trapped in the hole 46 when the covering grate 30 is placed on the support grate 22. The present embodiment provides a positive lock of the filter element 28 in place. Thus, there is less likelihood that the filter element 28 can be moved out of place by external forces which would allow silt to by-pass the filter element 28 and enter the catch basin 10.

Figure 7:
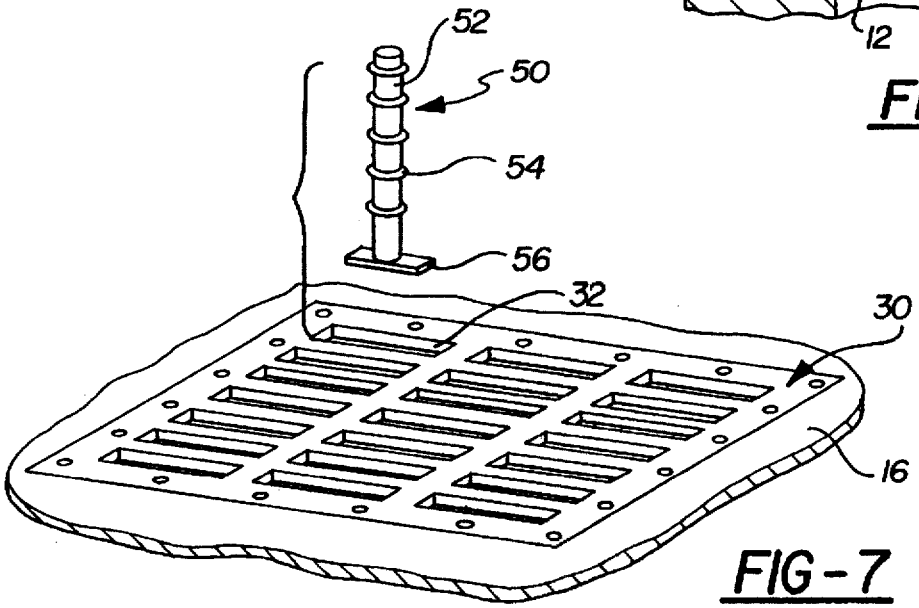
FIG. 7 is a perspective view showing the filter assembly of FIG. 5 in place over a storm sewer and an alternate handle means for removing the covering grate of the present invention.

In the embodiment shown in FIG. 7, there is shown a removable handle 50 for lifting the covering grate 30. The removable handle 50 includes a first member 52 preferably tubular in shape and having knurls 54 as well as a second member 56 at one end of the first member 52. The second member 56 is preferably perpendicular to the first member 52 and is sized to fit in a hole 32 in the covering grate 30 in a first aligned direction. Once the removable handle 50 is inserted in the hole 32, it is rotated 90°, preferably such that the second member 56 spans the width of the hole 32 and cannot be withdrawn therefrom. The removable handle 50 is then lifted to remove the covering grate 30. It is preferable to select a hole 32 near the center of the covering grate 30 so there is an equal balance while lifting and setting the covering grate 30.

The above process is reversed using the removable handle 50 to set the covering grate 30 back once the filter element 28 has been inspected and/or changed.

It should be appreciated that the covering grate 30, support grate 22 and removable handle 50 of the present invention may be made of any material appropriate for use in an environment covering an inlet grate 14. Suitable materials include metals including steel, alloys, plastics or any combination of materials.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A filter assembly positioned above an inlet grate of an inlet fixture of a storm sewer catch basin for removing particulate materials suspended in water entering the catch basin, the filter assembly comprising:

a support grate positioned above the inlet grate of the inlet fixture of a storm sewer catch basin, the support grate having a first plurality of openings therein;

a filter element supported by the support grate and covering the first plurality of openings, the filter element filtering out particulate materials suspended in the water so the particulate materials do not pass into the storm sewer catch basin; and a covering means positioned above the filter element, the covering means having a first plurality of openings therein.

2. A filter assembly according to claim 1 wherein the covering means has a generally horizontally extending member and wherein the support grate has a plurality of pads disposed about the first plurality of openings and the covering means has a plurality of holes disposed about the first plurality of openings in the covering means; each hole of the plurality of holes of the cover member corresponding with a pad of the support grate, the plurality of pads trapping the filter element in the plurality of holes of the covering means.

3. A filter assembly according to claim 2 wherein the covering means further comprises:

a depending peripheral member, the depending peripheral member depending past the filter element and past at least a portion of the support grate to position the covering grate means and the support grate.

4. A filter assembly according to claim 3 wherein the depending peripheral member of the covering means depends past the support grate and surrounds at least an upper portion of the inlet grate of the inlet fixture to position the filter assembly with respect to the inlet grate.

5. A filter assembly according to claim 1 further comprising handle means communicating with the covering means for removing the covering means from covering the filter assembly.

6. A filter assembly according to claim 5 wherein the handle means comprises a pair of generally U-shaped handles, each U-shaped handle having a spaced-apart pair of free ends, wherein the covering means is provided with a plurality of apertures, each of the free ends of each of the generally U-shaped handles extending through a respective aperture in the covering means, each of the generally U-shaped handles being rotatable with respect to the covering means through an arc, from a generally horizontally extending position to a generally vertically extending position.

7. A filter assembly according to claim 5 wherein the handle means comprises a removable handle having a handgrip portion and a hook portion, the hook portion engaging a hole of the second plurality of holes of the covering means.

8. A filter assembly according to claim 1 wherein the filter element is fabricated from a thin, planar sheet of a geotextile material.

9. In combination with an inlet grate of an inlet fixture of a storm sewer catch basin, a filter assembly positioned above the inlet grate for removing particulate materials suspended in a liquid entering the catch basin, the filter assembly comprising:

a support grate positioned above the inlet grate, the support grate having a first plurality of openings therethrough, at least some of the first plurality of openings being too large to block the flow of particulate materials;

a filter element supported on the support grate and covering all of the openings of the first plurality of openings, the filter element filtering out particulate materials suspended in the liquid so the particulate materials do not pass into the storm sewer catch basin through the first plurality of openings; and covering grate means positioned on the filter element for protecting and positioning the filter element, the covering grate means having a second plurality of openings therethrough, the second plurality of openings being too large to block the flow of particulate materials therethrough.

10. The combination according to claim 9 wherein the covering grate means has a generally horizontally extending member, the filter element has a plurality of holes, and the support grate of the filter assembly has a plurality of pads disposed thereon and positioned with respect to the first plurality of openings, the plurality of pads are received in the plurality of holes of the filter element and the plurality of pads support the generally horizontally extending member of the covering grate means at an elevation above the elevation of the filter element to provide space for an accumulation of particulate materials suspended on the filter element.

11. A combination according to claim 9 wherein the covering grate means of the filter assembly further comprises:

a depending peripheral member, the depending peripheral member depending past the filter element and at least a portion of the support grate to position the covering grate means with respect to the support grate, the depending peripheral member further circumscribing at least a portion of the inlet grate of the inlet fixture to position the filter assembly with respect to the inlet fixture.

12. A combination according to claim 9 wherein the covering grate means of the filter assembly further comprises handle means cooperating with the covering grate means for manually removing the covering grate means from the filter assembly.

13. A combination according to claim 12 wherein the handle means comprises an opposed pair of generally U-shaped members, each of the generally U-shaped members having a spaced-apart pair of free ends, wherein the covering grate means further comprises a plurality of apertures, each of the free ends of each of the generally U-shaped members being received in an aperture of the plurality of apertures of the covering grate means.

14. A combination according to claim 13 wherein each of the generally U-shaped members is rotatable with respect to the covering grate means through an arc from a generally horizontally extending position to a generally vertically extending position.

15. A combination according to claim 9 wherein the filter element of the filter assembly is fabricated from a thin, planar sheet of geotextile material.

16. A combination according to claim 9 wherein the support grate further comprises a plurality of pads disposed thereon, the covering grate means comprises a plurality of holes therein, the filter element is disposed on the support grate and covers the plurality of pads, and the plurality of pads are aligned with the plurality of holes in the cover grate means such that the filter element is trapped between the plurality of pads inserted in the plurality of holes in the cover grate means.

* * * * *

UNITED STATES PATENT AND TRADEMARK OFFICE

CERTIFICATE OF CORRECTION

PATENT NO. : 5,733,445

DATED : March 31, 1998

INVENTOR(S) : Fanelli

It is certified that error appears in the above-identified patent and that said Letters Patent is hereby corrected as shown below:

Column 1, line 20, after "much" insert a comma ",".

line 40, delete "charges" insert ---- changes ----.

Column 2, line 3, delete "damages" insert ---- damage ----.

line 25, delete "by-passing" and insert ---- bypassing ----.

line 42, after "drawings" insert a comma ---- , ----.

Column 3, line 28, after "which" insert ---- is ----.

line 53, after "pads" insert ---- or posts ----.

Column 4, line 7, delete "needlepunched" insert ---- needle-punched ----.

line 35, delete "the" first occurrence.

line 46, after "of" insert ---- the ----.

Column 5, line 6, delete "by-pass" insert ---- bypass ----.

line 14, delete "a hole" insert ---- an opening ----.

line 16, delete "hole" insert ---- opening ----.

UNITED STATES PATENT AND TRADEMARK OFFICE

CERTIFICATE OF CORRECTION

PATENT NO. : 5,733,445

DATED : March 31, 1998

INVENTOR(S) : Fanelli

It is certified that error appears in the above-identified patent and that said Letters Patent is hereby corrected as shown below:

Column 5, line 17, delete "hole" insert ---- opening ----.

line 20, delete "a" insert ---- an opening ----.

line 20, delete "hole".

line 63, delete "cover member" insert ---- covering means ----.

Column 6, line 3, delete "grate".

line 24, delete "5" insert ---- 11 ----.

line 27, after "covering" insert ---- grate ----.

Column 8, line 15 delete "cover" insert ---- covering ----.

line 17, delete "cover" insert ---- covering ----.

Signed and Sealed this

Twenty-seventh Day of April, 1999

*Attest:*

Q. TODD DICKINSON

*Attesting Officer*

*Acting Commissioner of Patents and Trademarks*